US011299833B2

(12) United States Patent
Catallo et al.

(10) Patent No.: US 11,299,833 B2
(45) Date of Patent: Apr. 12, 2022

(54) TORQUE AND SKEW REDUCTION IN TUBULAR KNITTED FABRIC

(71) Applicant: Fab-Con Machinery Development Corporation, Port Washington, NY (US)

(72) Inventors: James Catallo, Port Washington, NY (US); Christopher B. Snyder, Albemarle, NC (US)

(73) Assignee: FAB-CON MACHINERY DEVELOPMENT CORPORATION, Port Washingto, NY (US)

( * ) Notice: Subject to any disclaimer, the term of this patent is extended or adjusted under 35 U.S.C. 154(b) by 0 days.

(21) Appl. No.: 16/190,232

(22) Filed: Nov. 14, 2018

(65) Prior Publication Data

US 2019/0145037 A1 May 16, 2019

Related U.S. Application Data

(60) Provisional application No. 62/707,787, filed on Nov. 16, 2017.

(51) Int. Cl.
*D06C 5/00* (2006.01)
*D06C 3/08* (2006.01)
(Continued)

(52) U.S. Cl.
CPC ..... *D06C 5/00* (2013.01); *D04B 27/34* (2013.01); *D06C 3/062* (2013.01); *D06C 3/08* (2013.01);
(Continued)

(58) Field of Classification Search
CPC . D06C 5/00; D06C 5/005; D06C 3/06; D06C 3/062; D06C 3/08; D06C 2700/10; D06C 2700/05; D06C 3/065; D06C 3/067; D04B 27/34; D04B 15/88; B65H 23/025; B65H 23/0253; B65H 23/0258; B65H 23/038; B65H 23/0251; D06F 59/00; D06F 59/02; D06F 59/06
(Continued)

(56) References Cited

U.S. PATENT DOCUMENTS 207,192 A 8/1878 McLean
636,683 A 11/1899 Moussette
(Continued)

*Primary Examiner* — Amy Vanatta
(74) *Attorney, Agent, or Firm* — Carter, DeLuca & Farrell LLP

(57) ABSTRACT

The present invention includes aligning ring guides disposed at opposite angles to each other to force the tubular knitted fabric to turn in a spiral direction allowing the wales or rows of stitches to rest at an angle with respect to the edge of the tube of fabric. This is the normal or resting state and position of the wales in a wash-tested sample or laundered garment. This is accomplished by a pair of add-ons for torque and skew reduction in a tubular knitted fabric, which includes a crossbeam and a pair of angled ring guide assemblies that depend from the crossbeam. Each angled ring guide assembly has a mount with a fixed portion and a movable portion, and further has a guide ring, with each angled ring guide assembly being disposed on the movable portion. The fixed portion contains a crescent-shaped slot, with the movable portion containing a peg that rides in the slot.

17 Claims, 9 Drawing Sheets

(51) Int. Cl.
*D06C 3/06* (2006.01)
*D04B 27/34* (2006.01)

(52) U.S. Cl.
CPC ..... *D06C 2700/05* (2013.01); *D06C 2700/10* (2013.01)

(58) Field of Classification Search
USPC ..... 26/80, 83, 84, 85; 66/125 R, 149 R, 150, 66/152, 153
See application file for complete search history.

(56) References Cited

U.S. PATENT DOCUMENTS 1,347,714 A 7/1920 Rowley
1,636,683 A 7/1927 Cohn
1,775,894 A * 9/1930 Drabble ..... D06C 3/00 26/83
2,110,520 A * 3/1938 Cunnius ..... D06C 3/00 26/83
2,623,263 A * 12/1952 Dungler ..... D06C 5/00 26/84
2,623,264 A * 12/1952 Dungler ..... D06C 5/00 26/80
2,634,488 A * 4/1953 Cohn ..... D06C 5/00 26/84
2,680,279 A * 6/1954 Hamilton ..... D06C 5/00 26/84
3,166,651 A * 1/1965 Leimer ..... D06C 3/062 200/61.18
3,204,317 A * 9/1965 Hurt ..... D06C 5/00 26/18.5
3,616,502 A 6/1969 Aronoff
3,882,577 A * 5/1975 Aronoff ..... D06C 5/00 26/84
2,701,405 A 9/1975 Hoffman
4,299,878 A * 11/1981 Rheaume ..... D06H 7/12 139/291 C
4,554,714 A 11/1985 Cho
5,442,842 A * 8/1995 Nielsen ..... B65H 23/0258 26/80
5,867,879 A * 2/1999 Ferraro ..... D06C 5/00 26/83
6,499,202 B1 * 12/2002 Milanese ..... D06C 5/00 26/80

* cited by examiner

TORQUE AND SKEW REDUCTION IN TUBULAR KNITTED FABRIC

CROSS REFERENCE TO RELATED APPLICATIONS

The instant non-provisional patent applications claims priority from provisional patent application No. 62/707,787, filed on Nov. 16, 2017, by Christopher B. Snyder, for a TORQUE AND SKEW FORMATION IN TUBULAR KNITTED FABRIC, and is incorporated herein in its entirety by reference thereto.

BACKGROUND OF THE INVENTION

Field of the Invention

The embodiments of the present invention relate to torque and skew in tubular knitted fabric, and more particularly, the embodiments of the present invention relate to torque and skew reduction in tubular knitted fabric.

Description of the Prior Art

Knitted fabrics include interlocked loops of thread or yarn that intrinsically behave differently from woven fabrics.

The use of ring spun yarn in the knotting of Single Jersey (Knot Style) fabric causes the tube to turn in a spiral direction when washed and tumbled dry. This movement is referred to as "Torque" or "Skew." In garments with side seams, these seams will actually rotate circumferentially as the garment is washed and tumbled dry the first 3-5 washes. Retailers typically set the maximum allowable torque or skew at 5% or less.

Knotted fabric usually exits from a circular knitting machine in tubular form and is then dyed wet, then it is de-twisted, open in tubular form, extracted, chemical application is made. The fabric is dried in continuous form, and compacted in a dry condition. Single Jersey fabric has a natural tendency to twist in a spiral motion when a sample or garment is washed and tumbled dry.

Aligning the ring guides at opposite angles to each other to force the fabric tube to turn in a spiral direction allows the wales or rows of stitches to rest at an angle with respect to the edge of the tube. This is the normal or resting state and position of the wales in a wash-tested sample or laundered garment.

How Torque or Skew is Created in Tubular Fabric

Open End Yarn 20

As shown in FIG. 1, there is an open end yarn 20. Typically, air-jet or vortex spinning processes are used to produce the open end yarn 20. The individual staple or cotton fibers are twisted and compiled by air. The individual fibers can be multi-directional. This type of yarn has less strength and feels rougher as the ends of the fibers protrude from the yarn.

Ring Spun Yarn 22

As shown in FIG. 2, there is a ring spun yarn 22. The ring spun yarn 22 is made by initially combing the fibers in one direction then thinning them by drawing them down and then twisting them to produce a finer yarn that is stronger and softer. The strength is achieved by "interlocking" the fibers in the twisting process. The softness is achieved because the twisting envelopes the ends of the fiber in the yarn and they do not protrude where they can be felt.

The number of twists per linear inch is referred to as the twist multiple. For a 30/1S (Thirties single) yarn a typical twist multiple is 3.7". If the twist multiple is higher than 3.7", say for instance 3.9", then the torque in the single knit fabric produced from it will have more torque. Single Jersey is the most popular knit for T-shirts.

The higher the twist multiple, the stronger the yarn, but the torque is higher in single knit fabrics produced from it. The lower the twist multiple, the lower the tinsel strength, but the torque in single knit fabrics will also be reduced.

The length of the cotton staple affects the twist multiple. If yarn is made from long staple cotton, it requires less twists per inch or a lower twist multiple to produce a strong commercially acceptable yarn. If the cotton staple is short, then a higher twist multiple is required to meet the strength requirements. Egyptian cotton is highly desirable because the staple length, i.e., the length of a strand of fiber from a cotton ball is the longest in the world. This allows a yarn spinner to reduce the twist multiple, yet achieve a very strong and very soft yarn, as there are fewer ends of fiber per linear inch to feel.

As shown in FIG. 3, the ring yarn 22 can be produced in either "S" 24 or "Z" 26 twist. The majority of the ring spinning frames in production produce "Z" 26 twist of the ring yarn 22.

Circular Knitting Machine 28

As shown in FIG. 4, the circular knitting machine 28 contains thousands of needles within the knitting cylinder. The number of needles per inch varies with the diameter of the cylinder used to produce a certain diameter fabric depending on the size of the garment, as well as, a design component based on the type of style of fabric being produced.

Further, the circular knitting machine 28 includes feeders 30, needle detectors 32, and can produce stripe fabrics 34.

As shown in FIG. 5, individual spools of yarn are supplied to the needles by the feeders 30 of the circular knitting machine 28. The feeders 30 of the circular knitting machine 28 control tension on the yarn so that the desired fabric weight and courses or stitches per inch can be obtained. The number of feeders 30 of the circular knitting machine 28 can have a negative effect on torque/skew results in finished fabric. The higher the number of feeders 30 on the circular knitting machine 28, the higher the torque/skew.

Each feeder 30 of the circular knitting machine 28 comprises a ceramic eye pot 36, a knot catcher 38, a magnetic pressure 40, a yarn wheel 42, a warning light 44, a guide 46, and a sensor 48.

An example of a standard ring guide spreading system 50 can best be seen in FIGS. 6-9, and as such, will be discussed with reference thereto.

As shown in FIG. 6, the standard ring guide spreading system 50 comprises a crossbeam 52, and a pair of ring guides 54. The pair of ring guides 54 of the standard ring guide spreading system 50 depend from the crossbeam 52 of the standard ring guide spreading system 50.

As shown in FIG. 7, the standard ring guide system 50 further comprises an electric eye sensor arm 56.

The electric eye sensor arm 56 of the standard ring guide spreading system 50 comprises a mounting bracket 58. The mounting bracket 58 of the standard ring guide spreading system 50 mounts the electric eye sensor arm 56 of the standard ring guide spreading system 50 to the crossbeam 52 of the standard ring guide spreading system 50.

The electric eye sensor arm 56 of the standard ring guide spreading system 50 further comprises a power base 60. The power base 60 of the electric eye sensor arm 56 of the standard ring guide spreading system 50 is attached to the mounting bracket 58 of the standard ring guide spreading system 50.

The electric eye sensor arm 56 of the standard ring guide spreading system 50 further comprises an output module 62. The output module 62 of the electric eye sensor arm 56 of the standard ring guide spreading system 50 is attached to the mounting bracket 58 of the standard ring guide spreading system 50 and contains a powerhead 64.

The electric eye sensor arm 56 of the standard ring guide spreading system 50 further comprises a reflector 66. The reflector 66 of the electric eye sensor arm 56 of the standard ring guide spreading system 50 depends from the mounting bracket 58 of the standard ring guide spreading system 50.

As shown in FIG. 8, the standard ring guide system 50 further comprises a ring guider ball assembly 68. The ring guider ball assembly 68 of the standard ring guide system 50 attaches the ring guide to the mounting bracket 58 of the standard ring guide spreading system 50 via a ring support 70.

As shown in FIG. 9, the ring support 70 comprises a ring support idler 72, a first stud 74 extending from the ring support idler 72 of the ring support 70, a pair of bearings 76 interfacing with the first stud 74 of the ring support 70, a retaining ring 78 interfacing with the first stud 74 of the ring support 70, and a second stud 80 interfacing with the first stud 74 of the ring support 70.

Numerous other innovations for tubular knitted fabric machines have been provided in the prior art, which are described, infra, in chronological order to show advancement in the art, and which are incorporated herein in their entirety by reference thereto. Furthermore, even though these innovations may be suitable for the specific individual purposes to which they address, nevertheless, they would not be suitable for the purposes of the embodiments of the present invention as heretofore described, namely, torque and skew reduction in tubular knitted fabric, for example:

U.S. Pat. No. 207,192 to McLean

U.S. Pat. No. 207,192—issued to McLean on Aug. 20, 1878—teaches an improved machine simple in construction, inexpensive in manufacture, and effective in operation for straightening, stretching, and spreading fabrics in handling and finishing them.

U.S. Pat. No. 636,683 to Moussette

U.S. Pat. No. 636,683—issued to Moussette, filed on Oct. 13, 1898, and issued on Nov. 7, 1899—teaches a gas-generator by which the use of calcium-carbide tablets or receptacles can be dispensed with, and which is automatic in its operation.

U.S. Pat. No. 1,347,714 to Rowley

U.S. Pat. No. 1,347,714—issued to Rowley on Jul. 27, 1920—teaches certain improvements for scutching a fabric web to a definite width, and straightening the selvages before passing through the draw rolls. Heretofore, scutchers have been provided with a transverse governor bar between the scroll rolls and draw rolls, which bar was so pivoted that it had a tendency to cause the fabric to be properly guided to the draw rolls, whereby the selvage edges may travel through the draw rolls in substantially the same continuous alignment. The governor bar, however, was not reliable in its operation and moreover was not adjustable to be equally effective for all widths of fabric. More particularly, the invention dispenses with a governor bar heretofore employed and provides the scutcher between the scroll rolls and the draw rolls, with a pair of guiders, one at each side of the machine. The guiders are adapted to be adjusted to, or from, each other to suit different widths of fabric. The guider rolls are arranged obliquely to the selvages of the fabric and adapted to stretch the fabric transversely to its length, and at a time immediately before passing to the draw rolls. The action is to accurately govern the positioning of the selvages so that the fabric in passing through the draw rolls maintains a substantially constant relation longitudinally of the rolls, thereby insuring its delivery in a perfect manner, so that whether it is folded or rolled, the selvage edge at either end will lie accurately in the same plane. Further, the guiders act upon each selvage edge of the textile web in an independent manner, so that the accurate positioning of the selvages in passing through the draw rolls insures the maintaining of the alignment of the web at its place of delivery.

U.S. Pat. No. 1,636,683 to Cohn

U.S. Pat. No. 1,636,683—issued to Cohn on Jul. 26, 1927—teaches a machine for stretching, drying, and winding up tubular fabric. The machine may be used for various industries, but it is the first apparatus for stretching and drying tubular fabric of large diameter, such as, knitted fabric from which garments are to be made, which will handle the tubular fabric in such a manner as to maintain the wale of the fabric in a straight line, automatically, notwithstanding the irregular position of the fabric prior to its passage into the machine. The machine embodies apparatus for stretching the fabric to uniform diameter, and it is adapted to handle knitted fabric for the purpose of stretching it to the predetermined uniform size. The machine also embodies apparatus for rapidly drying fabric evenly to maintain uniformity of size. It also includes apparatus for winding the fabric into a roll, with the wale in a uniform straight line. Heretofore, in handling knitted fabric, where the fabric was passed over a stretching member and afterwards wound into a roll, there was a tendency for the knitted fabric to turn in relation to the stretching device so that when the fabric was wound into a roll the wale was disposed diagonally and not always at the same angle unless an operator were set at the winding machine to regulate its action in order to keep the fabric straight while being wound up. The machine provides a simple arrangement, whereby the operator may adjust one of the members over which the fabric travels to correct the tendency of the fabric to move spirally. In the fullest embodiment of the machine, the apparatus automatically controls the direction of the fabric, so that the wale continues in a straight line, even though the fabric is disposed irregularly before it reaches the machine.

U.S. Pat. No. 2,701,405 to Hoffman

U.S. Pat. No. 2,701,405—issued to Hoffman on Sep. 2, 1975—teaches a tenter frame having tenter chains and a succeeding cloth delivery station, in combination, screw-scanning devices mounted at the opposite sides of the cloth, and in advance of the tenter chains and the delivery station, separate weft-correcting mechanism additional to the tenter chains and mounted beyond the tenter chains and the delivery station in the direction of cloth travel. A control apparatus for the correcting mechanism, which is responsive to the indications of the skew-scanning devices, and a timing apparatus to delay corrective action by the weft-correcting mechanism until that portion of cloth which was indicated as requiring correction has reached the correcting mechanism.

U.S. Pat. No. 3,616,502 to Aronoff

U.S. Pat. No. 3,616,502—issued to Aronoff on Jun. 10, 1969—teaches an apparatus including, in succession, a floating pilot spreader for spreading a tubular fabric from twisted rope shape to a floating spreader for laterally overstretching the fabric, guide apparatus preceding the overstretching spreader for aligning the pattern of the tubular fabric as it is fed onto the spreader, rolls for taking the fabric off the spreader, and a conveyor for carrying the fabric to a subsequent finishing step, such as, drying.

U.S. Pat. No. 4,554,714 to Cho

U.S. Pat. No. 4,554,714—issued to Cho on Nov. 26, 1985—teaches a moving web expanding and guiding apparatus that includes, in combination, an expander device having three screw rolls arranged side by side, and a guide device having a required number of centering rolls. The intermediate screw roll is movable in a direction at right angles to the web surface, and the centering rolls are tillable in the direction that corrects the deviation of the web. The apparatus is provided with a screw roll emergency stop mechanism for quickly stopping the rotation of the screw rolls when the moving web excessively zigzag deviates, and a centering roll time delay stop mechanism for stopping the operation of a centering roll tilting mechanism when the centering rolls have returned to their neutral position.

SUMMARY OF THE INVENTION

Thus, an object of the embodiments of the present invention is to provide torque and skew reduction in tubular knitted fabric, which avoids the disadvantages of the prior art.

To avoid the disadvantages of the prior art, the embodiments of the present invention's aligning ring guides are disposed at opposite angles to each other to force the tube to turn in a spiral direction allowing the wales or rows of stitches to rest at an angle with respect to the edge of the tube of fabric. This is the normal or resting state and position of the wales in a wash tested sample or laundered garment.

Briefly stated, another object of the embodiments of the present invention is to provide a pair of add-ons for torque and skew reduction in a tubular knitted fabric, which includes a crossbeam and a pair of angled ring guide assemblies that depend from the crossbeam. Each angled ring guide assembly has a mount with a fixed portion and a movable portion, and further has a guide ring, with each angled ring guide assembly being disposed on the movable portion of the mount. The fixed portion of the mount contains a crescent-shaped slot, with the movable portion of the mount containing a peg that rides in the slot in the fixed portion of the mount.

The novel features considered characteristic of the embodiments of the present invention are set forth in the appended claims. The embodiments of the present invention themselves, however, both as to their construction and to their method of operation, together with additional objects and advantages thereof, will be best understood from the following description of the embodiments of the present invention when read and understood in connection with the accompanying figures of the drawing.

BRIEF DESCRIPTION OF THE FIGURES OF THE DRAWING

The figures of the drawing are briefly described as follows.

LIST OF REFERENCE NUMERALS UTILIZED IN THE FIGURES OF THE DRAWING

Prior Art

Figure 1:
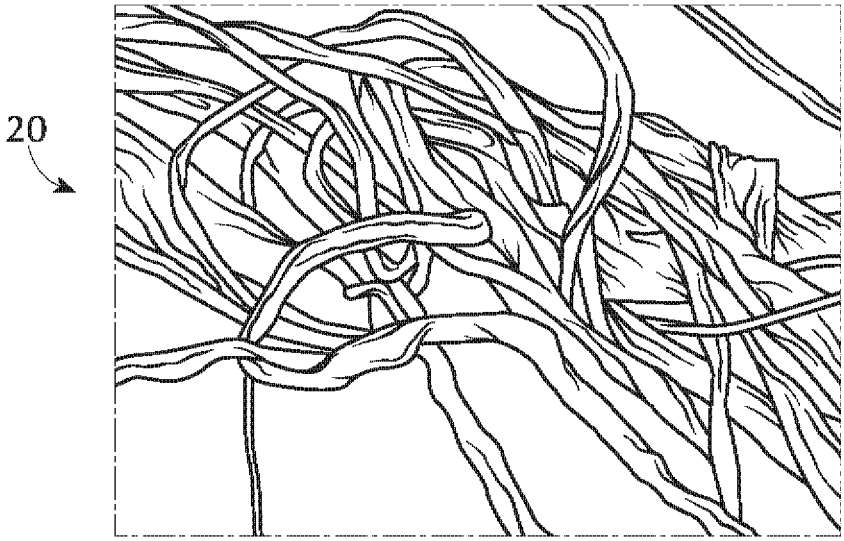
FIG. 1 PRIOR ART
FIG. 1 is a diagrammatic perspective view of a typical piece of open-end yarn.
Figure 2:
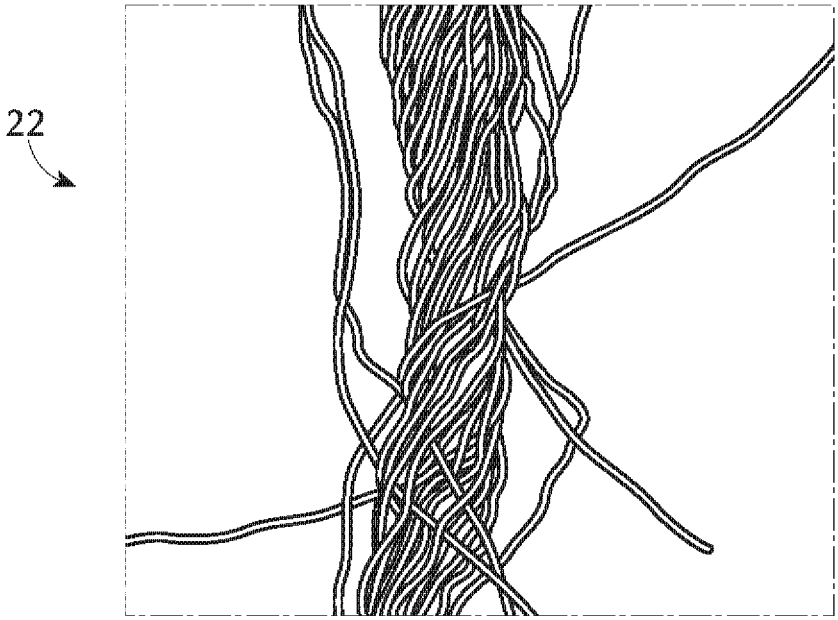
FIG. 2 PRIOR ART
FIG. 2 is a diagrammatic perspective view of a typical piece of ring spun yarn.
Figure 3:
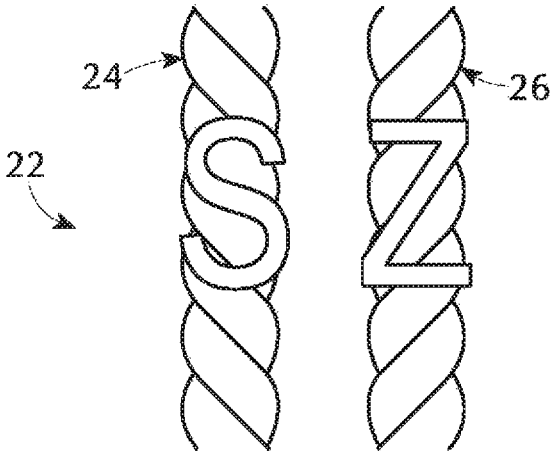
FIG. 3 PRIOR ART
FIG. 3 is a diagrammatic side elevational view of typical pieces of ring yarn produced in each of "S" and "Z" twist.
Figure 4:
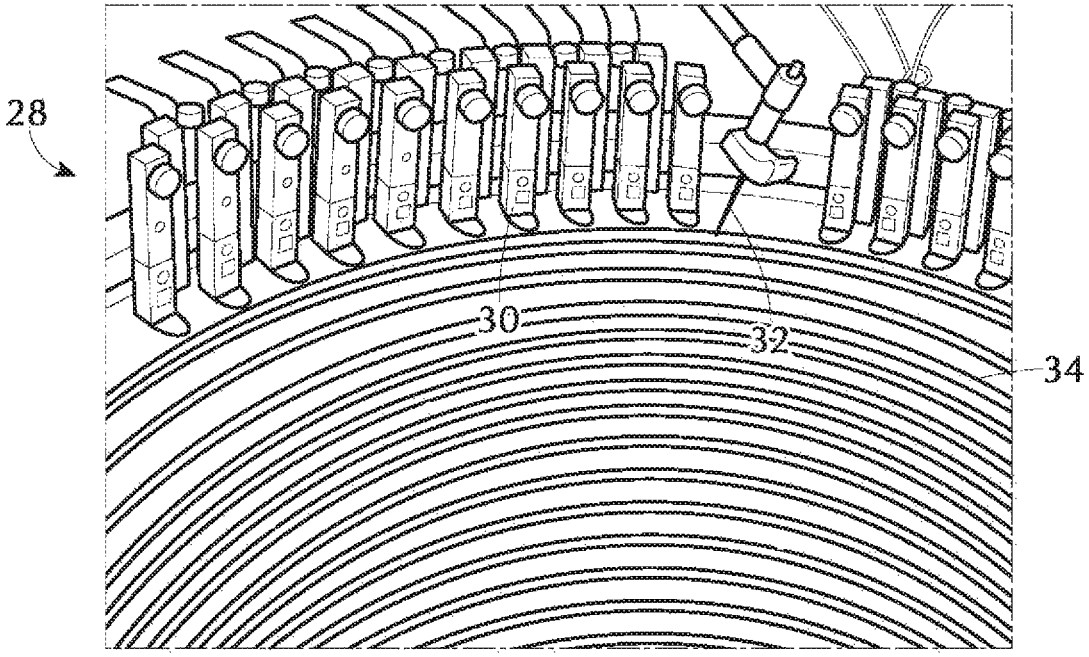
FIG. 4 PRIOR ART
FIG. 4 is a diagrammatic perspective view of a typical circular knitting machine.
Figure 5:
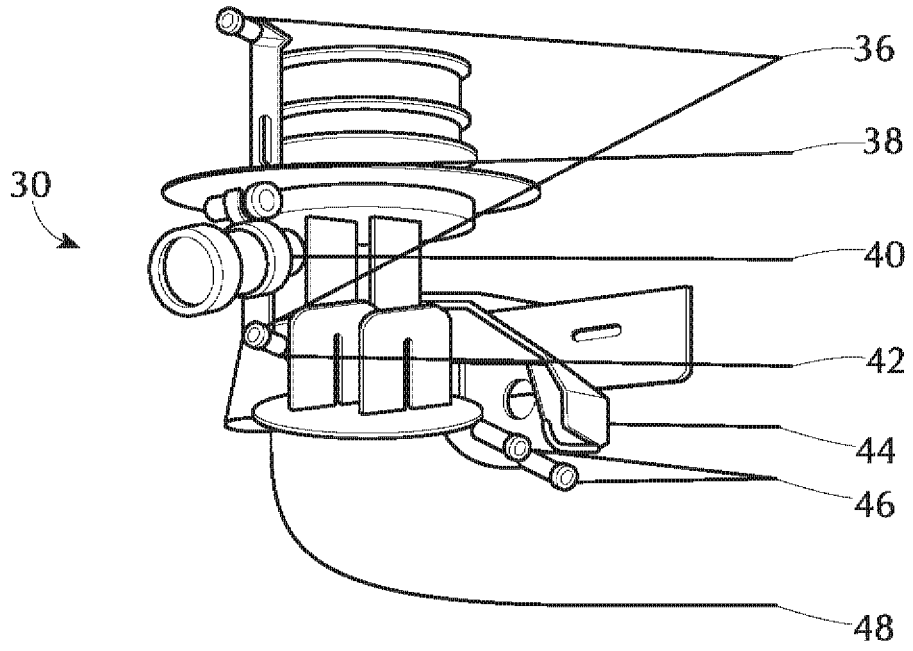
FIG. 5 PRIOR ART
FIG. 5 is a diagrammatic perspective view of a typical knit cylinder feeder.
Figure 6:
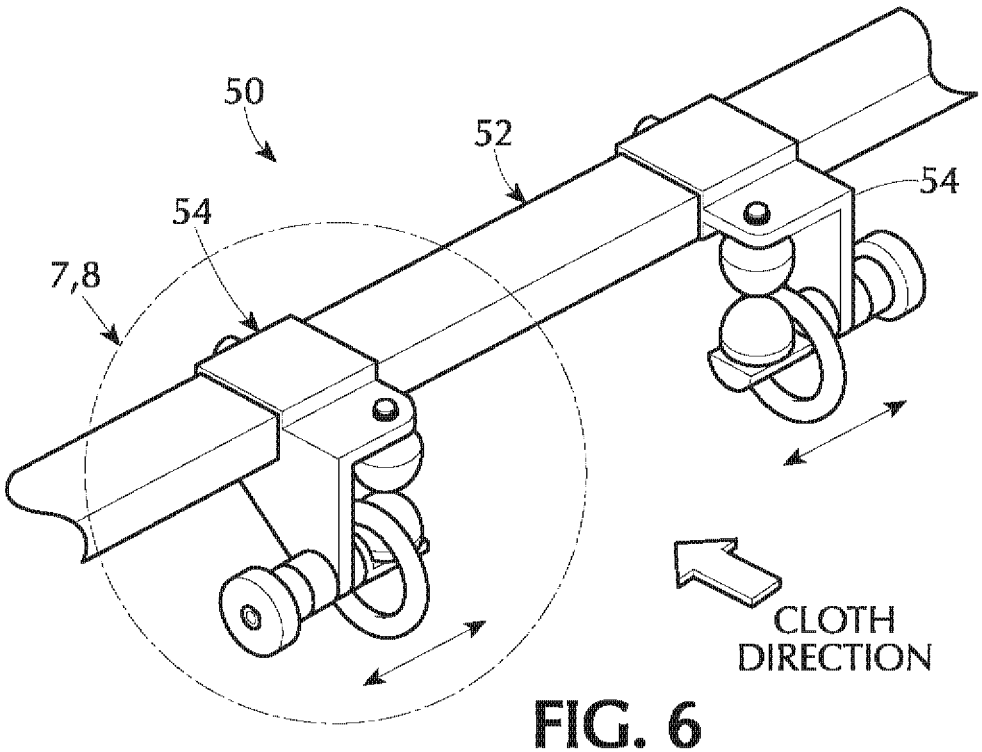
FIG. 6 PRIOR ART
FIG. 6 is a diagrammatic perspective view of a typical ring guide spreading system.
Figure 7:
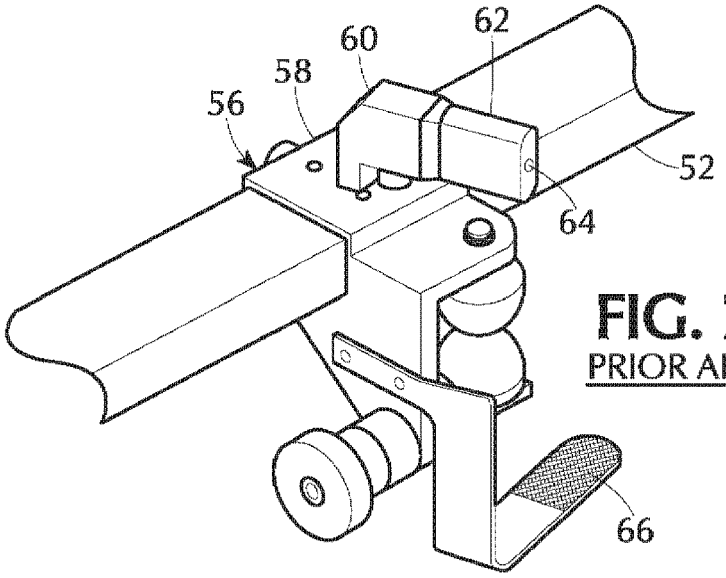
FIG. 7 PRIOR ART
FIG. 7 is a diagrammatic perspective view of the area generally enclosed by the dotted circle identified by ARROW 7 in FIG. 6 of a typical electric eye sensor arm.
Figure 8:
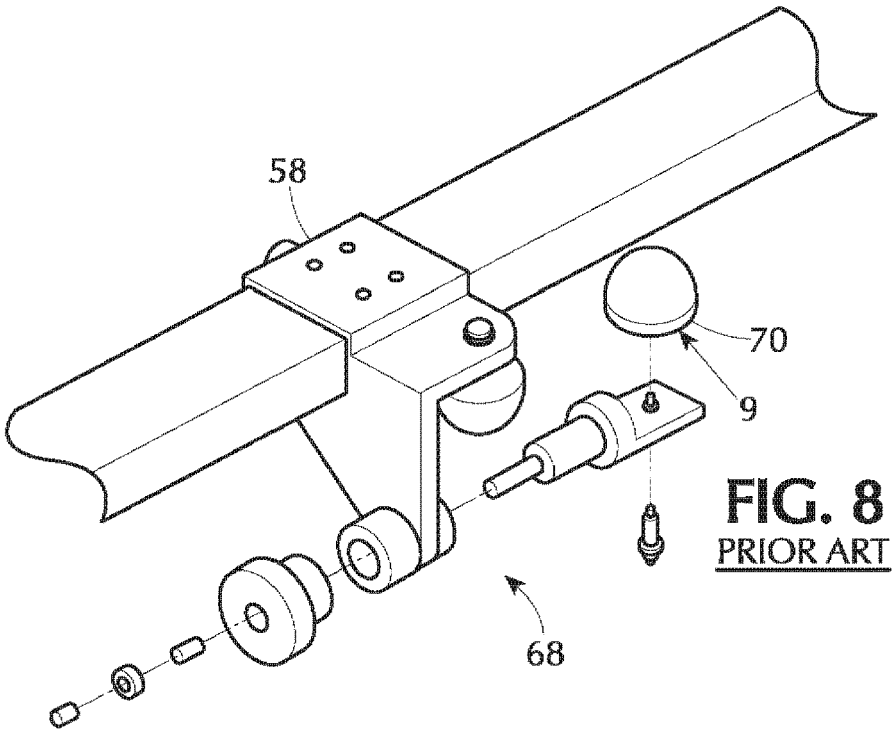
FIG. 8 PRIOR ART
FIG. 8 is an exploded diagrammatic perspective view of the area generally enclosed by the dotted circle identified by ARROW 8 in FIG. 6 of a typical electric eye sensor arm.
Figure 9:
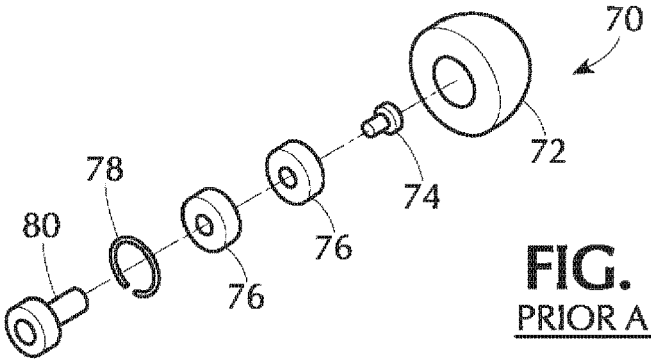
FIG. 9 PRIOR ART
FIG. 9 is an exploded diagrammatic perspective view of the area generally enclosed by the dotted circle identified by ARROW 9 in FIG. 8 of a typical ball assembly.

20 open end yarn
22 ring spun yarn
24 "S" twist of ring spun yarn 22
26 "Z" twist of ring spun yarn 22
28 circular knitting machine
30 feeders of circular knitting machine 28
32 needle detectors of circular knitting machine 28
34 stripe fabrics of circular knitting machine 28
36 ceramic eye pot of each feeder of feeders 30 of circular knitting machine 28

38 knot catcher of each feeder of feeders 30 of circular knitting machine 28
40 magnetic pressure catcher of each feeder of feeders 30 of circular knitting machine 28
42 yarn wheel of each feeder of feeders 30 of circular knitting machine 28
44 warning light of each feeder of feeders 30 of circular knitting machine 28
46 guide of each feeder of feeders 30 of circular knitting machine 28
48 sensor of each feeder of feeders 30 of circular knitting machine 28
50 standard ring guide spreading system
52 crossbeam of standard ring guide spreading system 50
54 pair of ring guides of standard ring guide spreading system 50
56 electric eye sensor arm of standard ring guide spreading system 50
58 mounting bracket of electric eye sensor arm 56 of standard ring guide spreading system 50
60 power base of electric eye sensor arm 56 of standard ring guide spreading system 50
62 output module of electric eye sensor arm 56 of standard ring guide spreading system 50
64 powerhead of output module 62 of electric eye sensor arm 56 of standard ring guide spreading system 50
66 reflector of electric eye sensor arm 56 of standard ring guide spreading system 50
68 ring guider ball assembly 68 of standard ring guide spreading system 50
70 ring support of standard ring guide spreading system 50
72 ring support idler of ring support 70 of standard ring guide spreading system 50
74 first stud of ring support 70 of standard ring guide spreading system 50
76 pair of bearings of ring support 70 of standard ring guide spreading system 50
78 retaining ring of ring support 70 of standard ring guide spreading system 50
80 second stud of ring support 70 of standard ring guide spreading system 50

Present Invention

Introductory

90 pair of add-ons of embodiments of present invention for torque and skew reduction in tubular knitted fabric Configuration

92 crossbeam
94 pair of angled ring guide assemblies
96 mount of each angled ring guide assembly 94
98 fixed position of mount 96 of each angled ring guide assembly 94
100 movable portion of mount 96 of each angled ring guide assembly 94
102 guide ring of each angled ring guide assembly
104 slot in fixed portion 98 of mount 96 of each angled ring guide assembly 94
106 peg of movable portion 100 of mount 96 of each angled ring guide assembly 94

EXAMPLES top neutral position of pair of add-ons 90
front neutral position of pair of add-ons 90
left view of 15° "S" twist position of each add-on 90
left view of 15° "Z" twist position of each add-on 90
left view of neutral position of each add-on 90
right view of 15° "S" twist position of each add-on 90
right view of 15° "Z" twist position of each add-on 90
right view of neutral position of each add-on 90

DETAILED DESCRIPTION OF THE PREFERRED EMBODIMENTS

Introductory

Figure 10:
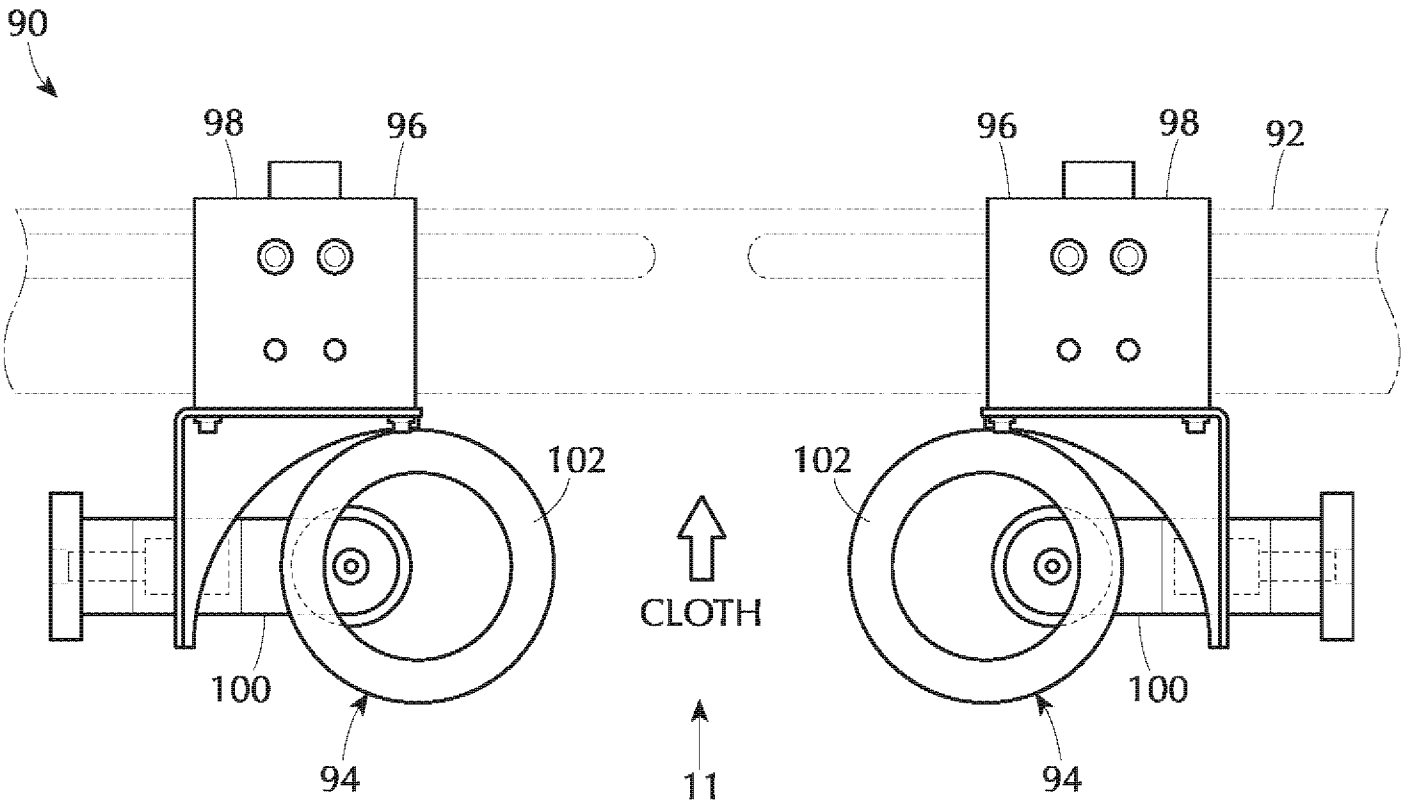
FIG. 10 is a diagrammatic top plan view of the torque and skew reduction in tubular knitted fabric of the embodiments of the present invention in a neutral position.
Figure 11:
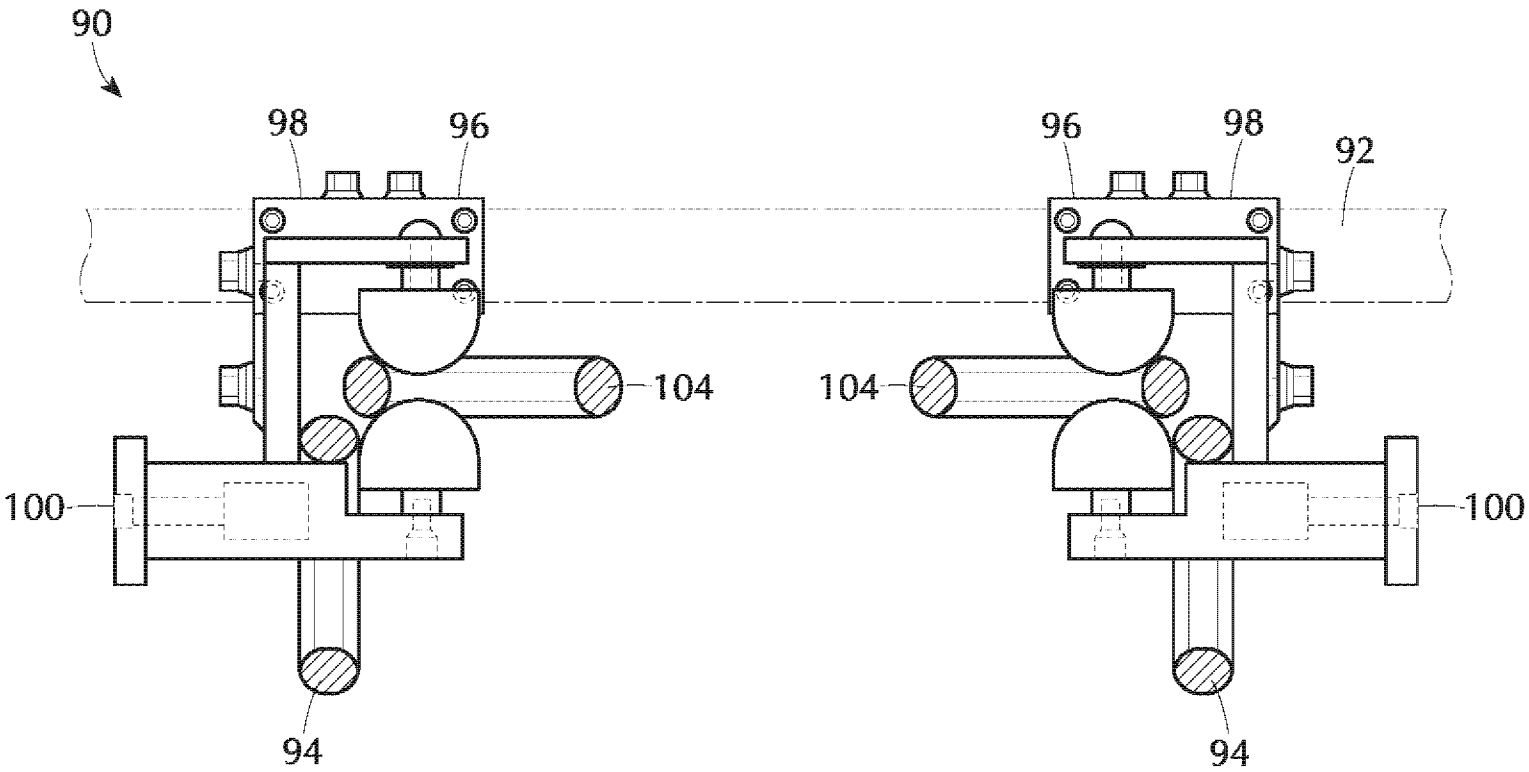
FIG. 11 is a diagrammatic front elevational view taken in the direction of ARROW 11 in FIG. 10 of the torque and skew reduction in tubular knitted fabric of the embodiments of the present invention in a neutral position.

Referring now to FIGS. 10 and 11, the pair of add-ons of the embodiments of the present invention is shown generally at 90 for torque and skew reduction in a tubular knitted fabric.

Configuration

The pair of add-ons 90 comprise a crossbeam 92, and each has a ring guide assembly 94. Each ring guide assembly 94 of each add-on 90 depends from the crossbeam 92 for torque and skew reduction in the tubular knitted fabric system.

Each ring guide assembly 94 of the pair of add-ons 90 has a mount 96. The mount 96 of each ring guide assembly 94 of the pair of add-ons 90 depends from the crossbeam 92.

Each mount 96 of each ring guide assembly 94 of the pair of add-ons 90 has a fixed portion 98 and a movable portion 100. The movable portion 100 of the mount 96 of each ring guide assembly 94 of the pair of add-ons 90 is pivotally attached to the fixed portion 98 of the mount 96 of an associated ring guide assembly 94 of an associated add-on 90.

Each ring guide assembly 94 of the pair of add-ons 90 further comprises a guide ring 102.

Each guide ring 102 is attached to the movable portion 100 of the mount 94 of an associated angled ring guide assembly 94, and is movable via the mount 94 of the associated angled ring guide assembly 94 for preventing torque and skew in the tubular knitted fabric.

As shown in FIGS. 12-17, the fixed portion 98 of the mount 96 of each angled ring guide assembly 94 contains a slot 104. The slot 104 in the fixed portion 98 of the mount 96 of each angled ring guide assembly 94 is crescent-shaped.

The movable portion 100 of the mount 96 of each angled ring guide assembly 94 further contains a peg 106. The peg 106 of the movable portion 100 of the mount 96 of each angled ring guide assembly 94 rides in the slot 104 of the fixed portion 98 of the mount 96 of an associated angled ring guide assembly 94 as the movable portion 100 of the mount 96 of the associated angled ring guide assembly 94 is pivoted.

Each angled guide ring 102 of the pair of angled ring guide assemblies is disposed on, and moves with, the movable portion 100 of the mount 96 of an associated angled ring guide assembly 94 as the movable portion 100 of the mount 96 of the associated angled ring guide assembly 94 pivots.

EXAMPLES

Example 1

The pair of add-ons 90 of the embodiments of the present invention is shown in FIG. 10 in a top neutral position.

Example 2

The pair of add-ons 90 of the embodiments of the present invention is shown in FIG. 11 in a front neutral position.

Example 3

Figure 12:
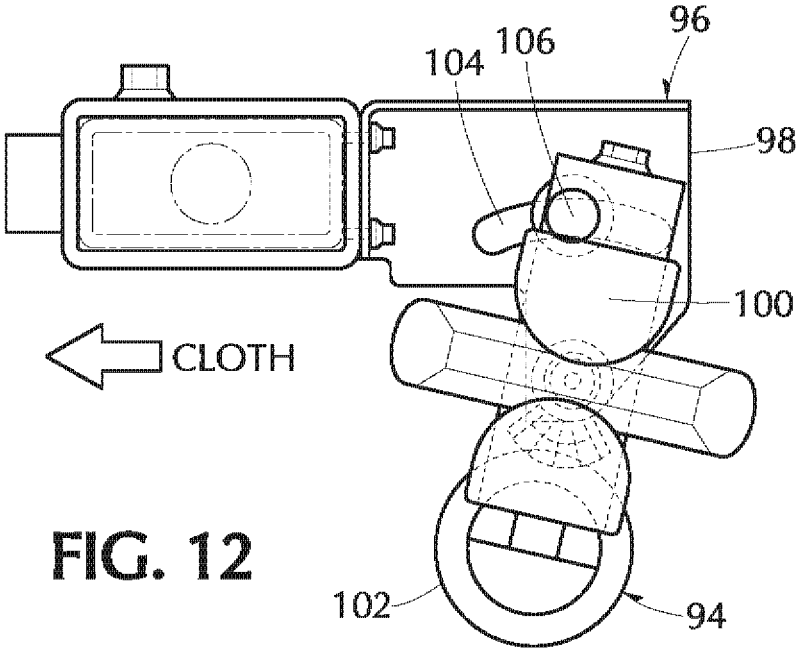
FIG. 12 is a diagrammatic left side view of the embodiments of the present invention in a 15° "S" twist position.

The pair of add-ons 90 of the embodiments of the present invention is shown in FIG. 12 in a left view of a 15° "S" twist position.

Example 4

Figure 13:
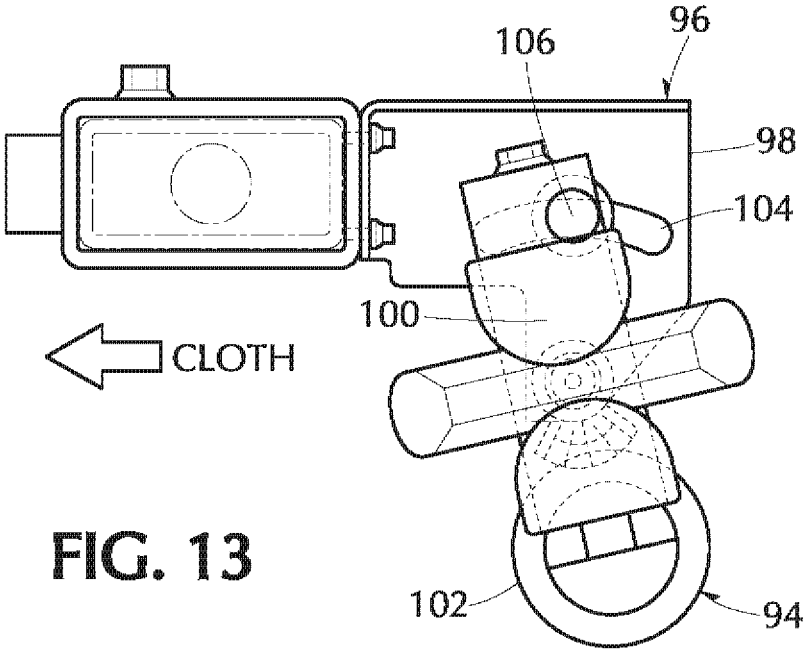
FIG. 13 is a diagrammatic left side view of the embodiments of the present invention in a 15° "Z" twist position.

The pair of add-ons 90 of the embodiments of the present invention is shown in FIG. 13 in a left view of a 15° "Z" twist position.

Example 5

Figure 14:
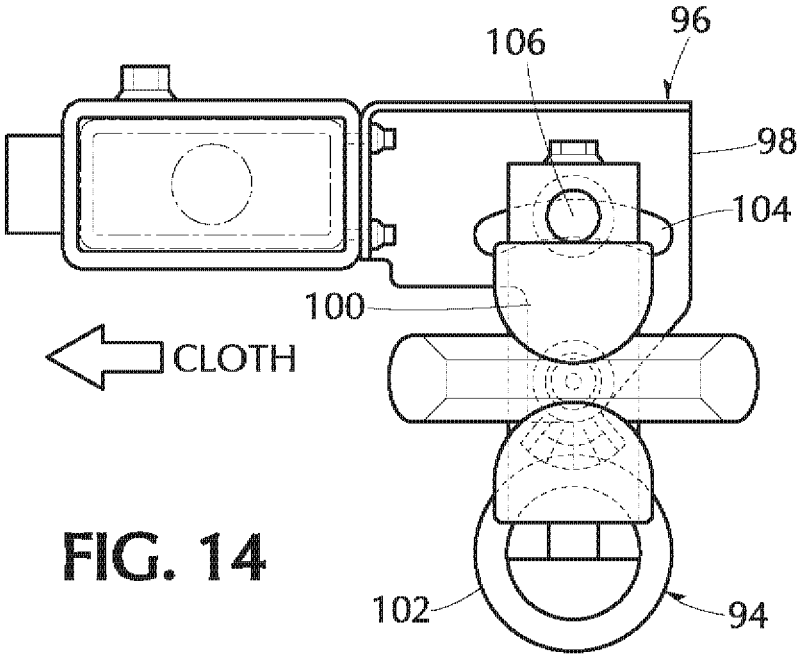
FIG. 14 is a diagrammatic left side view of the embodiments of the present invention in a neutral position.

The pair of add-ons 90 of the embodiments of the present invention is shown in FIG. 14 in a left view of a neutral position.

Example 6

Figure 15:
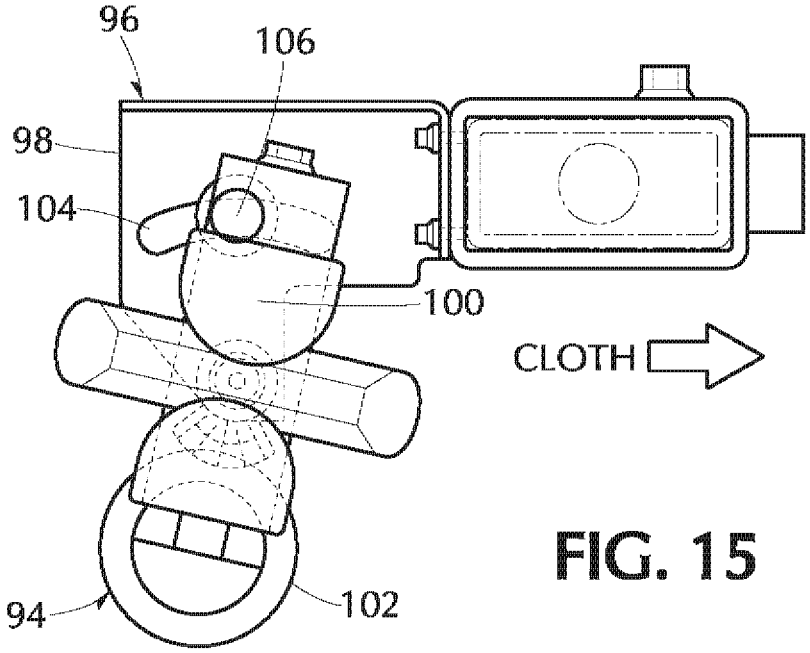
FIG. 15 is a diagrammatic right side view of the embodiments of the present invention in a 15° "S" twist position.

The pair of add-ons 90 of the embodiments of the present invention is shown in FIG. 15 in a right view of a 15° "S" twist position.

Example 7

Figure 16:
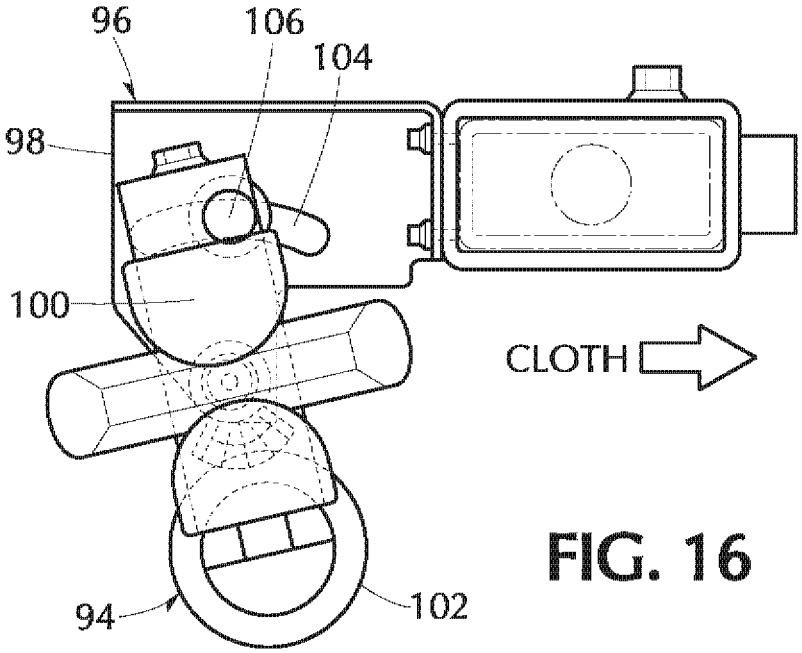
FIG. 16 is a diagrammatic right side view of the embodiments of the present invention in a 15° "Z" twist position.

The pair of add-ons 90 of the embodiments of the present invention is shown in FIG. 16 in a right view of a 15° "Z" twist position.

Example 8

Figure 17:
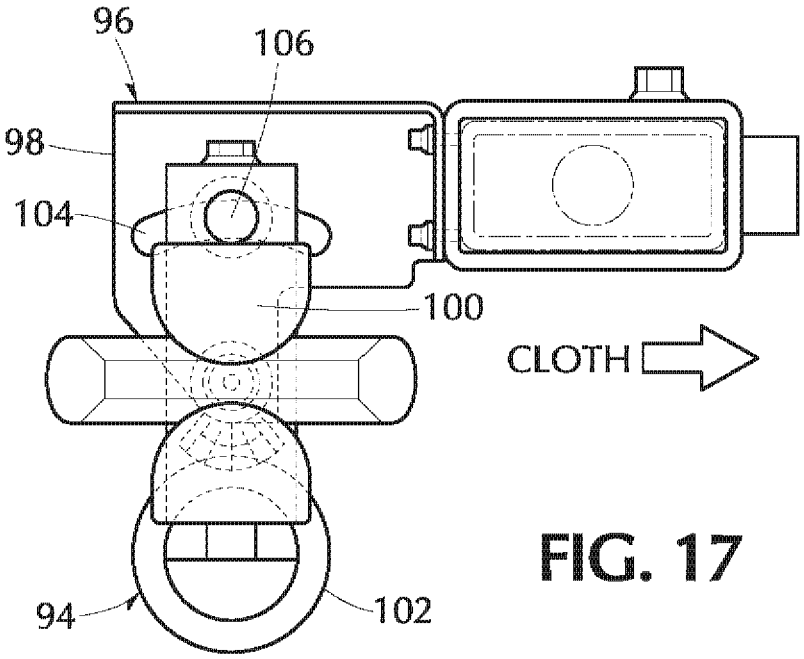
FIG. 17 is a diagrammatic right side view of the embodiments of the present invention in a neutral position.

The pair of add-ons 90 of the embodiments of the present invention is shown in FIG. 17 in a right view of a neutral position.

APPENDIX

Attached hereto is an appendix disclosing the tests conducted using the present invention and the results obtained therefrom.

Impressions

It will be understood that each of the elements described above, or two or more together, may also find a useful application in other types of constructions differing from the types described above.

While the embodiments of the present invention have been illustrated and described as embodied in torque and skew reduction in tubular knitted fabric, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A pair of add-ons for torque and skew reduction in a tubular knitted fabric system, comprising:

a) a crossbeam; and b) a pair of angled ring guide assemblies, each angled ring guide assembly includes:

a mount having a fixed portion and a movable portion, the fixed portion including a crescent-shaped slot; wherein said pair of angled ring guide assemblies depend from said crossbeam for torque and skew reduction in the tubular knitted fabric system.

2. The add-ons of claim 1, wherein said movable portion of said mount of each angled ring guide assembly is pivotally attached to said fixed portion of said mount of an associated angled ring guide assembly.

3. The add-ons of claim 1, wherein each angled ring guide assembly comprises a guide ring.

4. The add-ons of claim 3, wherein each guide ring is attached to said movable portion of said mount of an associated angled ring guide assembly.

5. The add-ons of claim 3, wherein each guide ring is movable via said mount of an associated angled ring guide assembly for reducing torque and skew in the tubular knitted fabric.

6. The add-ons of claim 1, wherein said movable portion of said mount of each angled ring guide assembly contains a peg.

7. The add-ons of claim 6, wherein said peg of said movable portion of said mount of each angled ring guide assembly rides in said slot of said fixed portion of said mount of an associated angled ring guide assembly as said movable portion of said mount of said associated angled ring guide assembly is pivoted.

8. The add-ons of claim 1, wherein each angled ring guide assembly is disposed on said movable portion of said mount of an associated angled ring guide assembly as said movable portion of said mount of said associated angled ring guide assembly pivots.

9. The add-ons of claim 1, wherein each angled ring guide assembly moves with said movable portion of said mount of an associated angled ring guide assembly as said movable portion of said mount of said associated angled ring guide assembly pivots.

10. The add-ons of claim 1, wherein each add-on has a top neutral position.

11. The add-ons of claim 1, wherein each add-on has a front neutral position.

12. The add-ons of claim 1, wherein each add-on has a left 15.degree. "S" twist position.

13. The add-ons of claim 1, wherein each add-on has a left 15.degree. "Z" twist position.

14. The add-ons of claim 1, wherein each add-on has a left neutral position.

15. The add-ons of claim 1, wherein each add-on has a right 15.degree. "S" twist position.

16. The add-ons of claim 1, wherein each add-on has a right 15.degree. "Z" twist position.

17. The add-ons of claim 1, wherein each add-on has a right neutral position.

* * * * *